US005887397A

United States Patent [19]

Repasky

[11] Patent Number: 5,887,397

[45] **Date of Patent: *Mar. 30, 1999**

[54] AERODYNAMICALLY STABLE ROOF SYSTEM AND BALLAST BLOCKS

[76] Inventor: John Repasky, 140 Bender Rd., Hanover, Pa. 17331

[ * ] Notice: The term of this patent shall not extend beyond the expiration date of Pat. No. 5,377,468.

[21] Appl. No.: 491,949

[22] PCT Filed: Dec. 29, 1994

[86] PCT No.: PCT/US94/14995

§ 371 Date: Jul. 14, 1995

§ 102(e) Date: Jul. 14, 1995

[87] PCT Pub. No.: WO96/21068

PCT Pub. Date: Jul. 11, 1996

Related U.S. Application Data

[63] Continuation-in-part of Ser. No. 53,917, Apr. 27, 1993, Pat. No. 5,377,468.

[51] Int. Cl.[6] ..... E04B 5/00; E04B 7/00; E04C 1/39; E04D 3/24

[52] U.S. Cl. ..... 52/302.4; 52/604; 52/605; 52/606; 52/592.1

[58] Field of Search ..... 52/302.4, 302.1, 52/505, 539, 592.1, 408, 604, 605, 606, 607

[56] References Cited

U.S. PATENT DOCUMENTS

| | | | |
|---|---|---|---|
| 339,799 | 4/1886 | McAllister | 52/605 |
| 576,569 | 2/1897 | Genner | 52/592.1 |
| 721,751 | 3/1903 | Scot | 52/604 |
| 774,276 | 11/1904 | Reiff | 52/592.1 |
| 1,277,829 | 9/1918 | Baum | 52/607 X |
| 1,397,035 | 11/1921 | Colosimo | 52/505 X |
| 1,455,657 | 5/1923 | Pontello . | |
| 1,495,896 | 5/1924 | Fergusin | 52/505 X |
| 2,124,084 | 7/1938 | Sauereisen | 52/605 |
| 3,077,703 | 2/1963 | Bergstrom . | |
| 3,079,730 | 3/1963 | Donegan . | |
| 3,305,982 | 2/1967 | Steele | 52/606 X |
| 3,387,420 | 6/1968 | Long . | |
| 3,619,961 | 11/1971 | Sterrett et al. | 52/302.1 |
| 3,969,851 | 7/1976 | Whitacre . | |
| 4,274,238 | 6/1981 | O'Riordian . | |
| 4,506,483 | 3/1985 | Phalen, Jr. . | |
| 4,535,579 | 8/1985 | Burgoyne et al. . | |
| 4,655,018 | 4/1987 | Pardo . | |
| 4,798,036 | 1/1989 | Pardo | 52/604 X |
| 4,977,730 | 12/1990 | Pardo . | |
| 5,070,669 | 12/1991 | Tsai | 52/408 X |
| 5,377,468 | 1/1995 | Repasky | 52/302.4 |

FOREIGN PATENT DOCUMENTS

| | | | |
|---|---|---|---|
| 517620 | 1/1921 | France | 52/592.1 |
| 145908 | 6/1931 | Sweden | 52/604 |
| 144377 | 6/1920 | United Kingdom | 52/604 |
| 560822 | 4/1944 | United Kingdom | 52/604 |

*Primary Examiner*—Robert Canfield
*Attorney, Agent, or Firm*—Howson and Howson

[57] ABSTRACT

A protected-membrane roof paving system (10) and blocks (12) for use therein. Rectangular ballast blocks (12) are laid in rows. The blocks (12) have channels providing for drainage and equalization of air pressure above and below the blocks (12) under adverse wind conditions.

20 Claims, 10 Drawing Sheets

AERODYNAMICALLY STABLE ROOF SYSTEM AND BALLAST BLOCKS

CROSS-REFERENCE TO RELATED APPLICATION

This application is a continuation-in-part of U.S. application Ser. No. 08/053,917 filed Apr. 27, 1993, issued as U.S. Pat. No. 5,377,468 on Jan. 3, 1995.

FIELD OF THE INVENTION

The present invention relates generally to roof paving systems, and more particularly it relates to an improved protected-membrane roof system which is aerodynamically stable in unusual wind conditions and to ballast blocks for use in such system.

BACKGROUND OF THE INVENTION

Recent developments in roof paver technology have resulted in the introduction of single-ply protected-membrane roof systems which are especially suitable for low-sloped roofs and decks. They usually include a single-ply water-impermeable membrane, with or without thermal insulation layers, held in place and protected from the elements by ballast systems of various types and configurations. Basic systems include loose-laid well-rounded stones such as river gravel, standard paving blocks, composite tongue-and-groove board, and lightweight interlocking ballast blocks. In general, ballast systems are often the preferred system of choice in areas where exposure to high wind conditions may be anticipated because they are capable of withstanding greater wind velocities than conventional built-up roofing systems. Studies have also shown that ballast systems which utilize interlocking blocks perform even better under adverse (strong) wind conditions than non-interlocking ballast systems.

The interlocking blocks are usually extruded or pre-cast concrete of flat rectangular shape laid over a roof membrane in a contiguous grid pattern. However, even this construction does not assure dislodgement of the ballast blocks under certain weather conditions. High velocity winds, such as of hurricane-force, passing over irregular or critical roof locations may induce an aerodynamic pressure differential across the blocks to lift them out of place. Instead of simply making ballast blocks heavier and the roof supports stronger, various designs have evolved for resisting the lifting force, such as the aforementioned lightweight ballast blocks secured to each other by interlocking edges. However, despite these design efforts, the net upward aerodynamic loading acting on the ballast blocks may lift them into the airstream like flying missiles and endanger people and other structures in the vicinity as well as expose the underlying roof membrane and substructure to damage.

In U.S. Pat. No. 5,377,468, there is disclosed an improved aerodynamically stable ballast block and roof system providing several features. These features include positive interlocking of the blocks, and complete protection of the roof membrane from ultra-violet radiation. The blocks and system are suited for use in a wide range of geographical areas subject to a wide range of atmospheric conditions.

There may be conditions and applications in which less than all of the advantages of the patented blocks would be required.

For instance, in regions where ultra-violet radiation on the roof membrane is of less concern, block vents which do not provide a labyrinthine flow path across the blocks may be utilized. In other situations, where less than a continuous interlock is adequate, the blocks may be provided with other edge structures which operatively engage one another to resist lifting. The present invention provides blocks and a roof system intended to address these conditions.

OBJECTS OF THE INVENTION

With the foregoing in mind, it is an object of the present invention to provide a roof paver system and ballast blocks designed and laid to resist lifting out of place under unusual wind conditions. Another object is to provide roof ballast blocks which are suitable for use with adjacent blocks of like construction in a manner that permits air to flow freely between the topsides and bottom-sides of blocks upon exposure to aerodynamically-induced reductions in air pressure above the blocks.

Still another object is to provide ballast blocks which form channels for both equalizing air pressure above and below the laid blocks and permitting fluids to pass through.

A further object of the invention is to provide a roof construction having a unique arrangement of ballast blocks which resists failure due to aerodynamic lift induced by unusual wind conditions and which resists deterioration due to freeze-thaw cycles.

A still further object is to provide prefa-bricated ballast blocks which are lightweight, resistant to breakage in handling, can be manufac-tured at low cost, and which are relatively easy to install.

SUMMARY OF THE INVENTION

Briefly, these and other objects of the invention are accomplished by providing novel ballast blocks which are preferably laid in a staggered pattern over a roof membrane. Each block is defined by generally parallel flat top and bottom sides and peripheral edge faces. In some of the embodiments, the edge faces opposite each other have, respectively, a projecting tongue and a complementary groove for interlocking with corresponding tongues and grooves of edge faces of adjacent blocks. In other embodiments the edge faces are beveled and overlap to operatively engage one another. In still other embodiments, adjacent blocks have substantially vertical edge faces which abut, or are in closely-spaced relation, thereby operatively locking the blocks in place.

In one preferred embodiment, the remaining pair of edge faces has a flat surface perpendicular to the top and bottom sides of the block, and its other opposite edge face has a longitudinal groove and upper and lower recesses opening into the groove from the topside and bottomside at spaced intervals. In a plane perpendicular to the top and bottom sides on the block, the recesses on one side of the groove are offset from the recesses on the other side to form with the groove a series of labyrinthine channels between the top and bottom sides of the block when abutted with the flat edge of an adjacent block. In further other embodiments channels are formed either across selected edge faces or within the body of each block.

In some of the embodiments, ribs project from the bottom side of the block to provide feet for defining a chamber between the underside of the block and the roof membrane. The channels enable water to drain to a gutter, downspout or similar discharge means communicating with the chamber beneath the blocks. The channels provide drainage while equalizing across the top and bottom sides of the blocks any differential air pressure caused by aerodynamic forces.

BRIEF DESCRIPTION OF THE DRAWINGS

For a better understanding of these and other objects, features and advantages of the invention, reference is made to the following detailed description taken in conjunction with the accompanying drawings, wherein.

DESCRIPTION OF THE PREFERRED EMBODIMENTS

Figure 1:
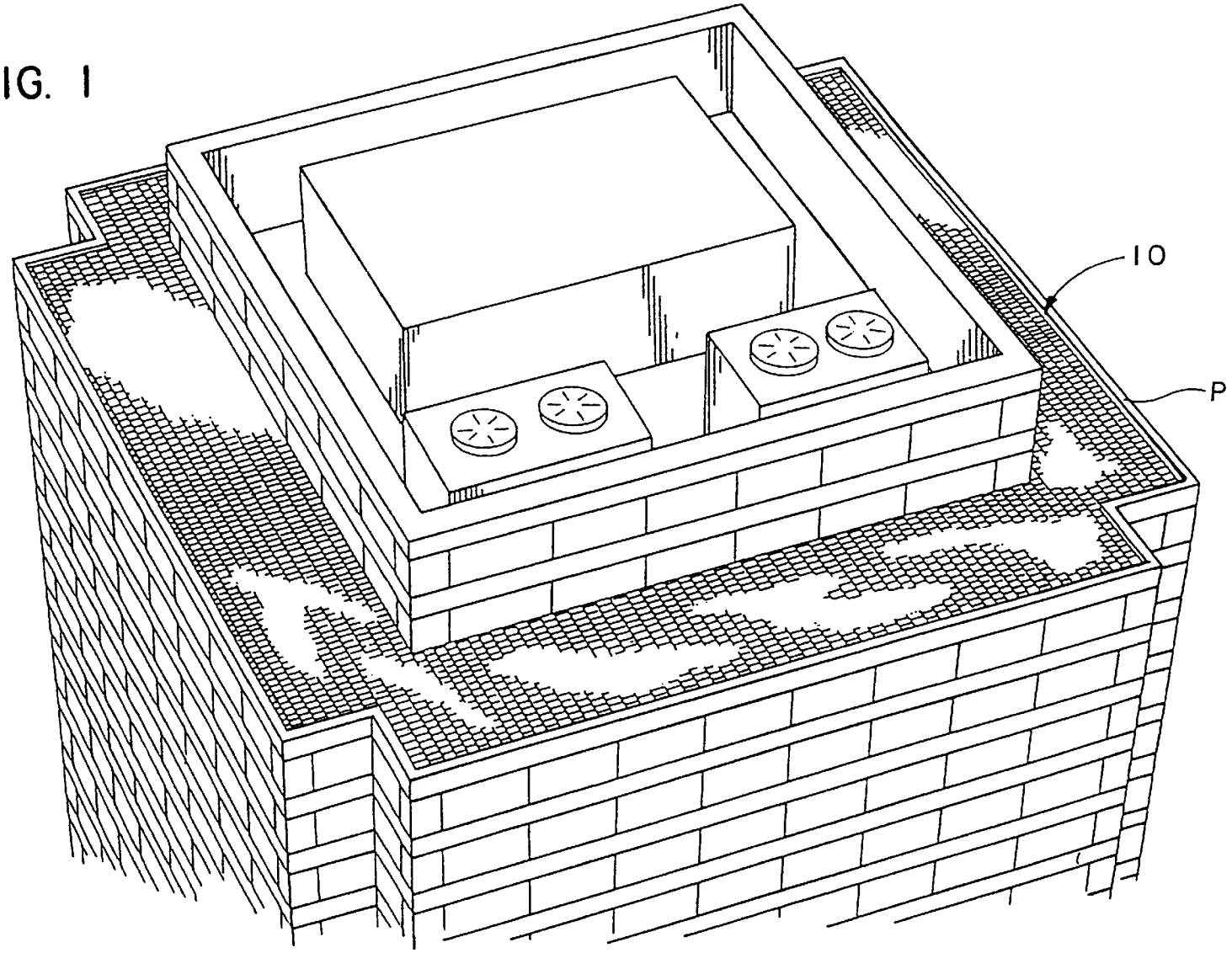
FIG. 1 represents an aerial view of a building with a roof paver system with ballast blocks according to the invention.

Referring now to the drawings, FIG. 1 illustrates a protected-membrane roof system 10 of the present invention installed on the roof of a high-rise building. Such a building is particularly prone to being exposed to high velocity winds tending to lift conventional roof ballast blocks. The present invention overcomes the proclivity of conventional blocks to be aerodynamically unstable under high wind conditions by providing a unique means for equalizing air pressure across the blocks.

Figure 2:
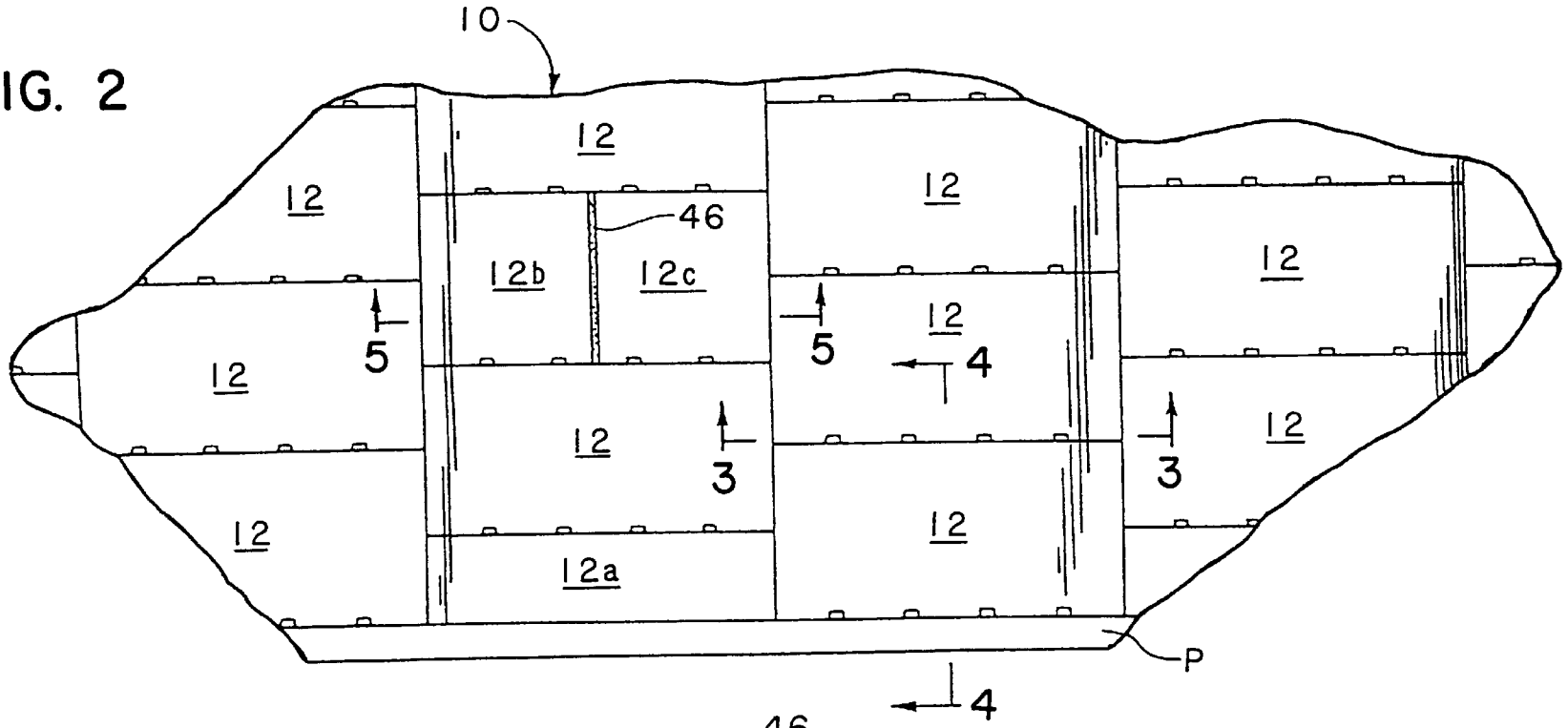
FIG. 2 represents a plan view of one embodiment of ballast blocks in a section of the roof paver system of FIG. 1.

As best illustrated in FIG. 2, the roof ballast system 10 comprises ballast blocks 12 which are preferably laid in like orientation in contiguous rows with the blocks in each row staggered laterally in side-by-side relation with blocks in adjacent rows. The ends of rows with insufficient space for a full-size block, such as at roof parapet P, are accommodated by a narrowed block 12*a*. Damaged blocks in an existing installation can be replaced, as shown, with complementary half blocks 12*b* and 12*c*, as will be discussed.

Figure 3:
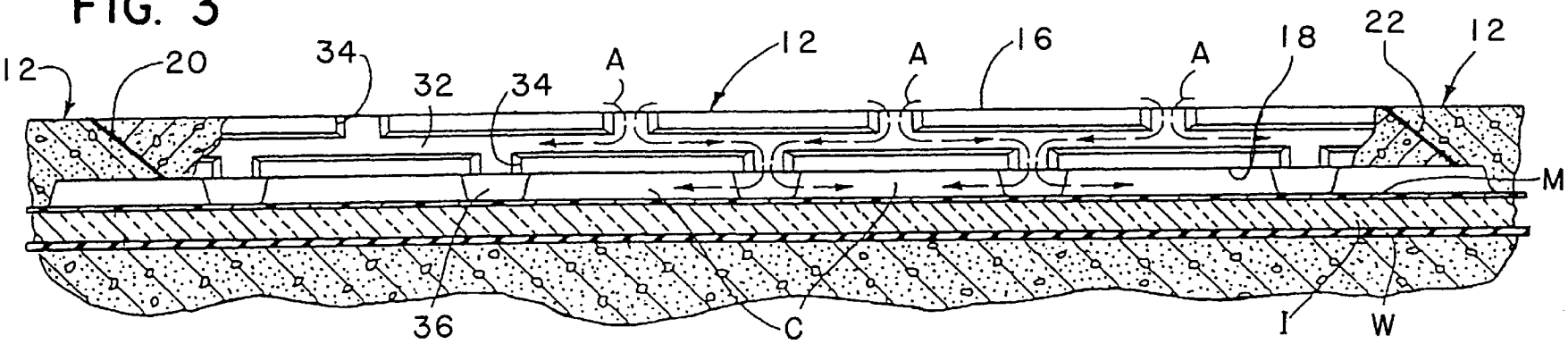
FIG. 3 is an elevation view of the roof paver system taken along the line 3—3 of FIG. 2.
Figure 4:
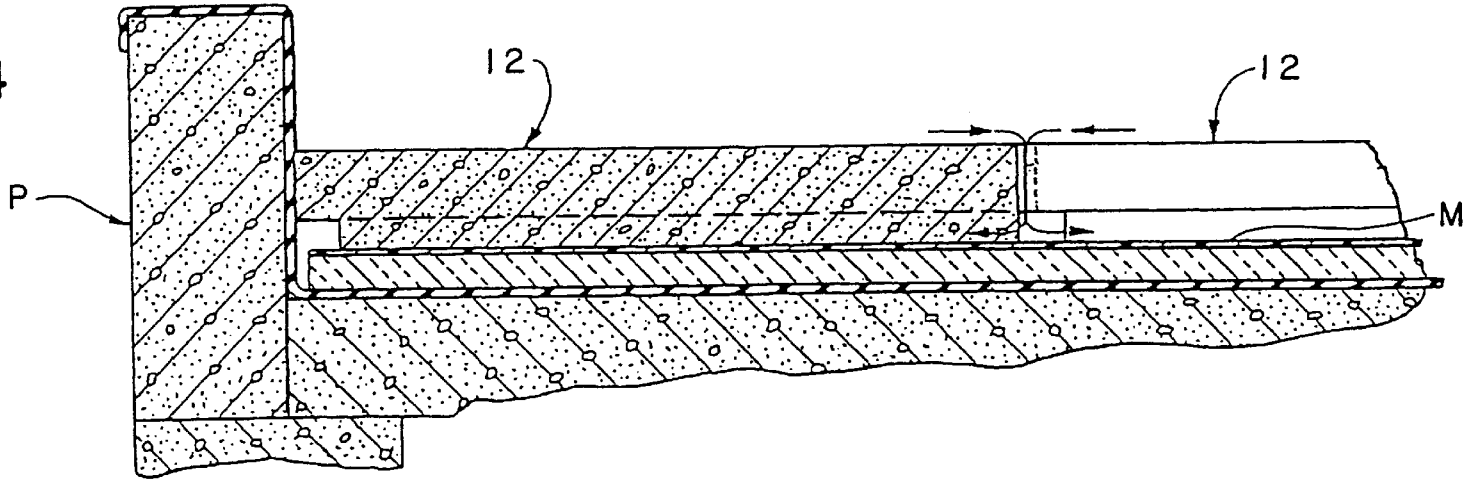
FIG. 4 is an elevation view of an alternate embodiment of the roof paver system taken along the line 4—4 of FIG. 2.

Referring now to FIGS. 3 and 4, a conventional multi-component roof system which may include a water-impermeable membrane M, such as single-ply PVC sheet, insulation I, and a water proofing layer W. Other conventional multi-component roofing systems are contemplated for use with the roof ballast system of the invention, depending on design requirements, such as conditions of use, building codes, etc.

Referring generally to FIGS. 6 through 12, each ballast block 12 is polygonal in plan, having a generally rectangular configuration in the illustrated embodiments. The block 12 is formed of concrete to have flat top and bottom sides 16 and 18, opposed widthwise edge faces 20 and 22, and opposed lengthwise edge faces 24 and 26.

Figure 7:
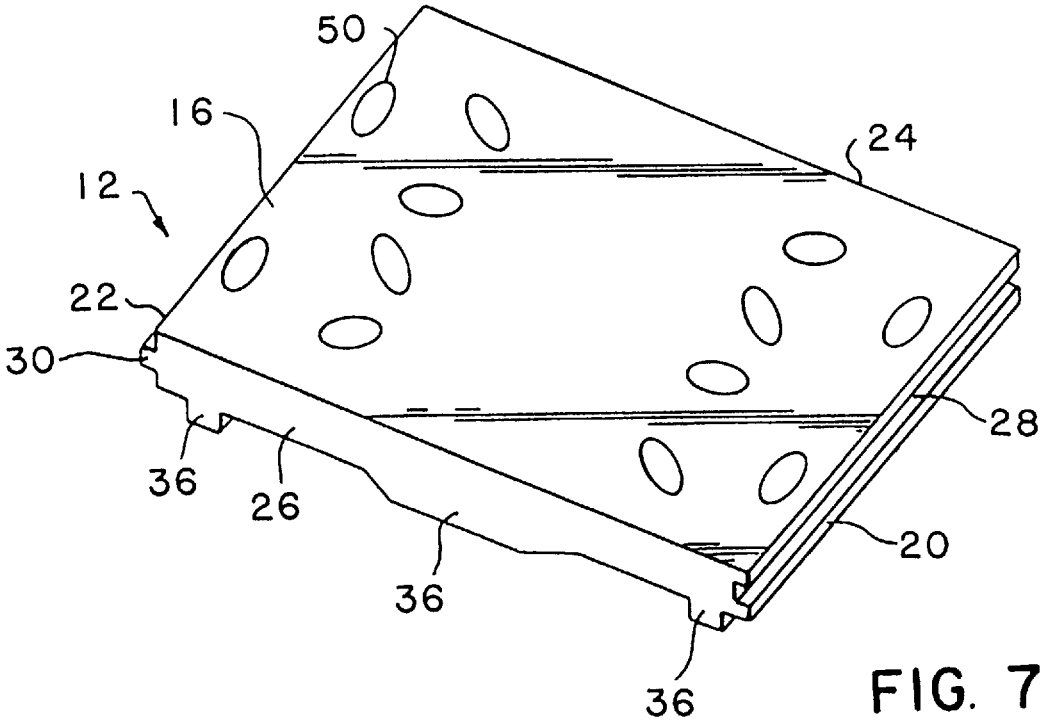
FIG. 7 is an isometric view from above of an alternate embodiment of a ballast block.

In each embodiment of block 12, at least two of the edge faces interact with adjacent blocks in some manner. For instance, FIG. 7 illustrates a block 12 having a tapered groove 28 formed along the full length of the widthwise face 20 corresponding in width and depth to a tapered tongue 30 extending along the full length of widthwise face 22. The blocks 12 of FIG. 7 in adjacent rows interlock at their complementary tongue and groove edge faces 20 and 22. The staggered relationship of blocks 12 in adjacent rows assures that an edge face 20 or 22 of each block 12 overlaps interlocking edge faces 22 or 20, respectively, of two blocks 12 in the adjacent row. Hence, the laid blocks 12 interact with one another to resist usual lifting forces.

Figure 5:
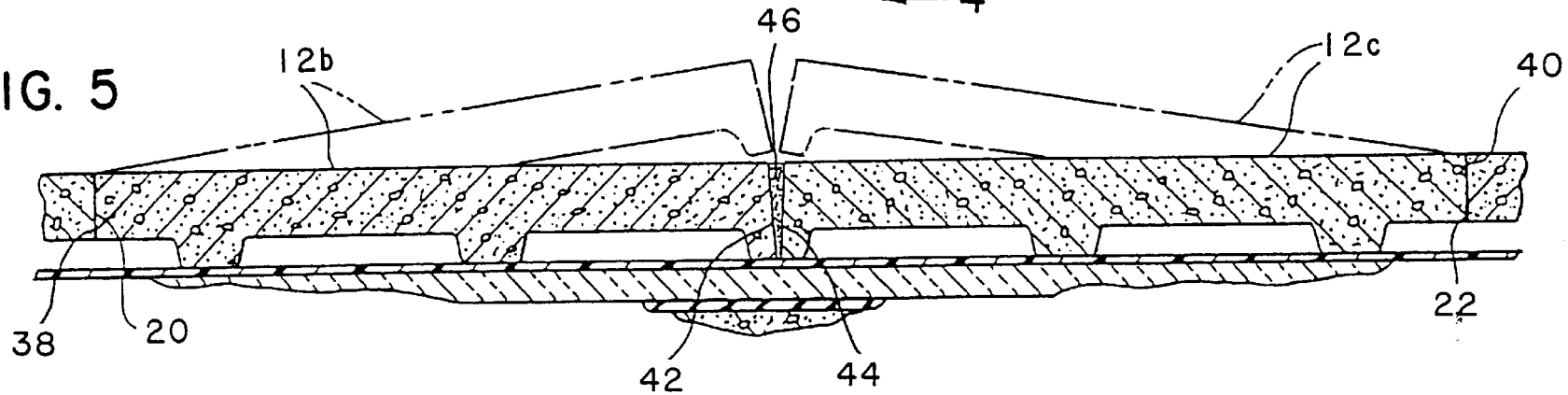
FIG. 5 is an elevation view of the roof paver system taken along the line 5—5 of FIG. 2.
Figure 6:
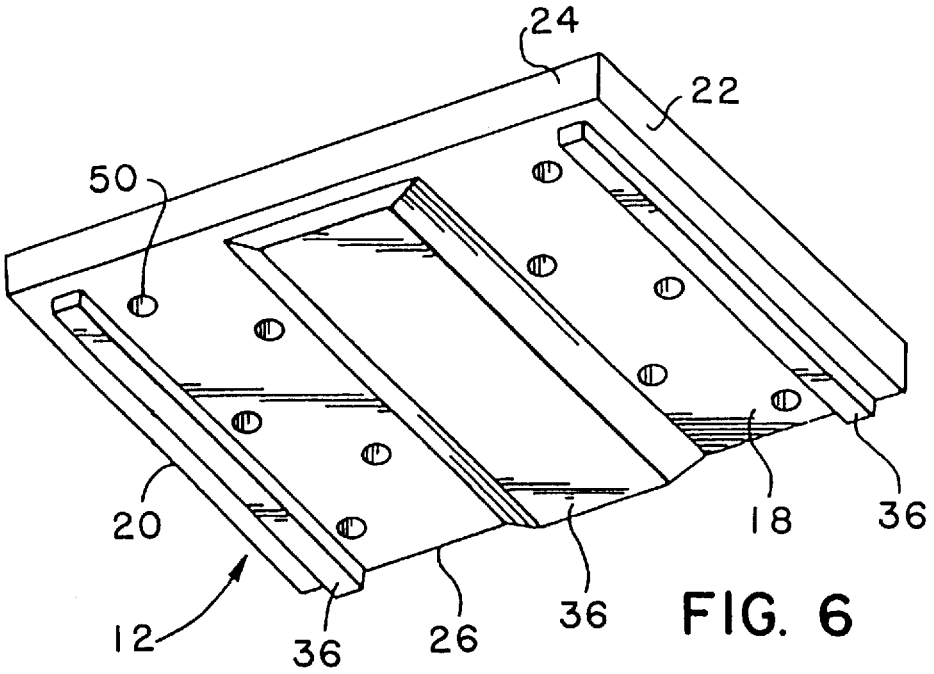
FIG. 6 is an isometric view from below one embodiment of a ballast block.
Figure 8:
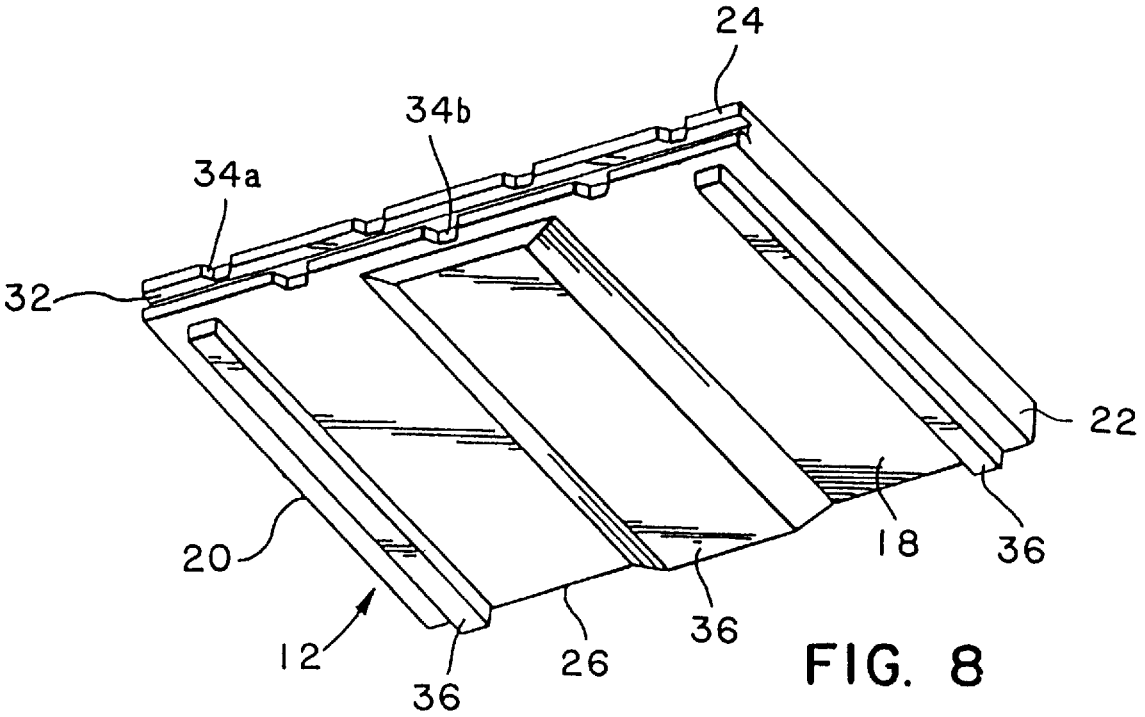
FIG. 8 is an isometric view from below a second alternate embodiment of a ballast block.

Another embodiment of a block 12 having edge face interaction is illustrated in FIGS. 6 and 8. Widthwise edge faces 20 and 22 are substantially vertical and are held in place by laterally abutting adjacent blocks. Depending on the thickness of the blocks, they may be separated slightly along their edges, with operative engagement occurring as they tend to pivot upward. Also, concrete adhesives may be applied between the block edges to secure them together permanently. See FIG. 5.

Figure 9:
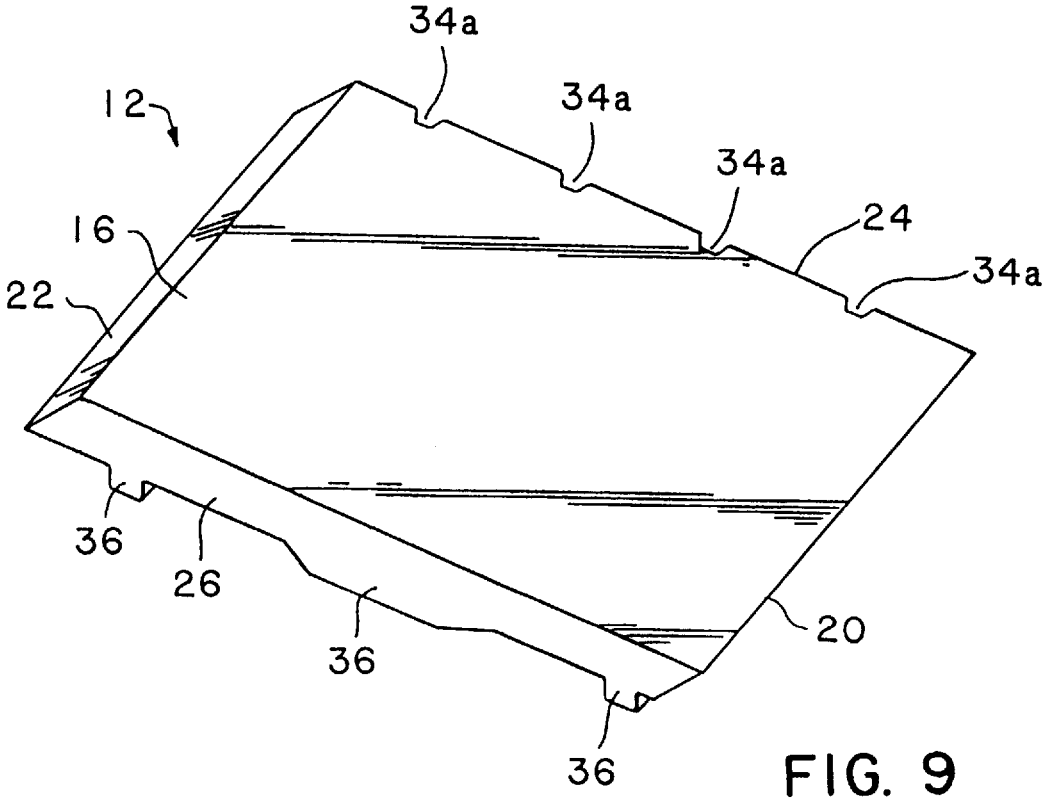
FIG. 9 is an isometric view from above a third alternate embodiment of a ballast block.
Figure 11:
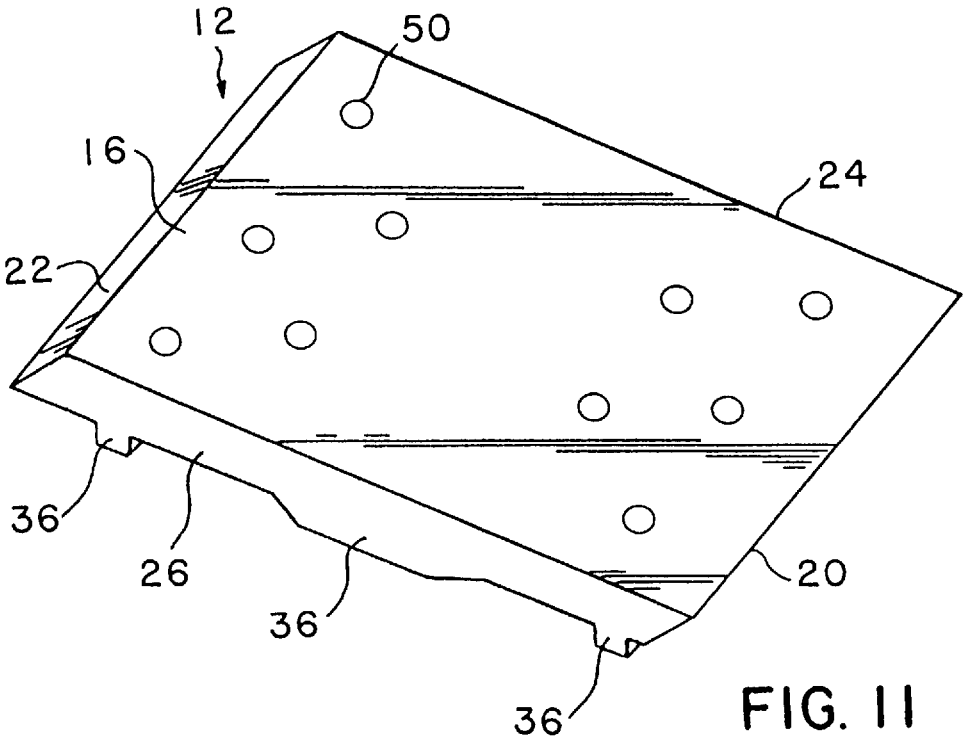
FIG. 11 is an isometric view from above a fourth alternate embodiment of a ballast block.

A further embodiment of a block 12 having edge face interaction is illustrated in FIGS. 9 and 11. In this embodiment, widthwise edge faces 20 and 22 are beveled so that they overlap with adjacent block widthwise edge faces to effect operative engagement by means of a shiplap configuration. However, other overlapping configurations can be utilized to provide the desired partial interlock. See FIGS. 3, 9 and 11.

In each embodiment of block 12, air and water channels are provided with means to effect equalization of air pressure above and below laid blocks to resist aerodynamic lift induced by wind conditions.

For instance, FIGS. 3, 8, 9 and 13–16 illustrate a block 12 having one form of means that provides desirable air and water channels. Block edge faces 24 and 26 are generally flat in a plane perpendicular to top and bottom sides 16 and 18, with lengthwise-extending face 24 including a groove 32 extending along the full length thereof. Upper and lower recesses 34*a* and 34*b*, respectively, are provided in the block edge face 24 at spaced intervals along its length. The recesses 34*a* and 34*b* extend completely between groove 32 and top and bottom sides 16 and 18, respectively of the block 12. In a plane perpendicular to sides 16 and 18, upper recesses 34*a* are offset from lower recesses 34*b*, preferably by half the distance between adjacent recesses. Thus, with edge faces 24 and 26 of adjacent blocks 12 abutted as shown in FIG. 2, a labyrinthine channel is formed across edge face 24. The number, size, shape and location of recesses 34*a* and 34*b* can be modified as desired.

Figure 10:
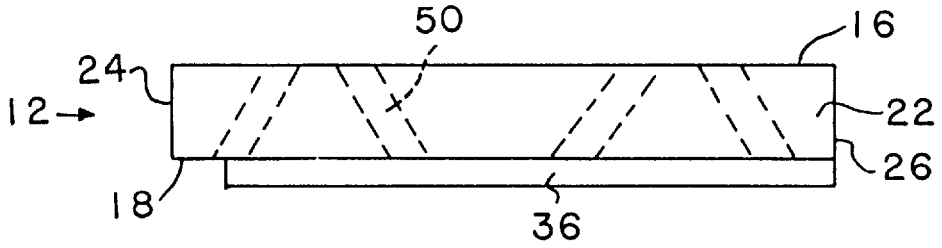
FIG. 10 is a side elevational view of the ballast block of FIG. 6 having angled channels.
Figure 12:
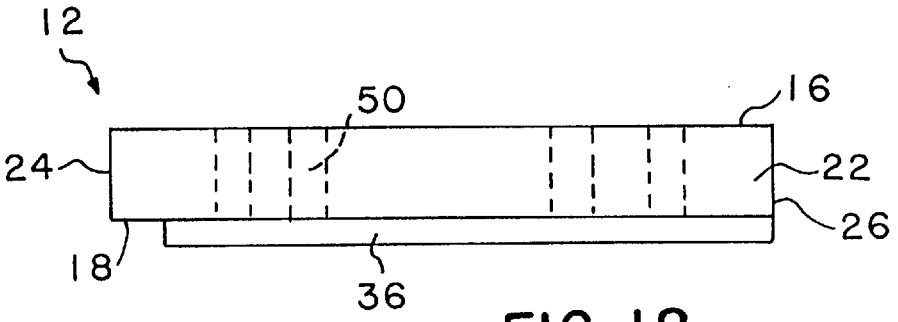
FIG. 12 is a side elevational view of the ballast block of FIG. 6 having vertical channels.
Figure 13:
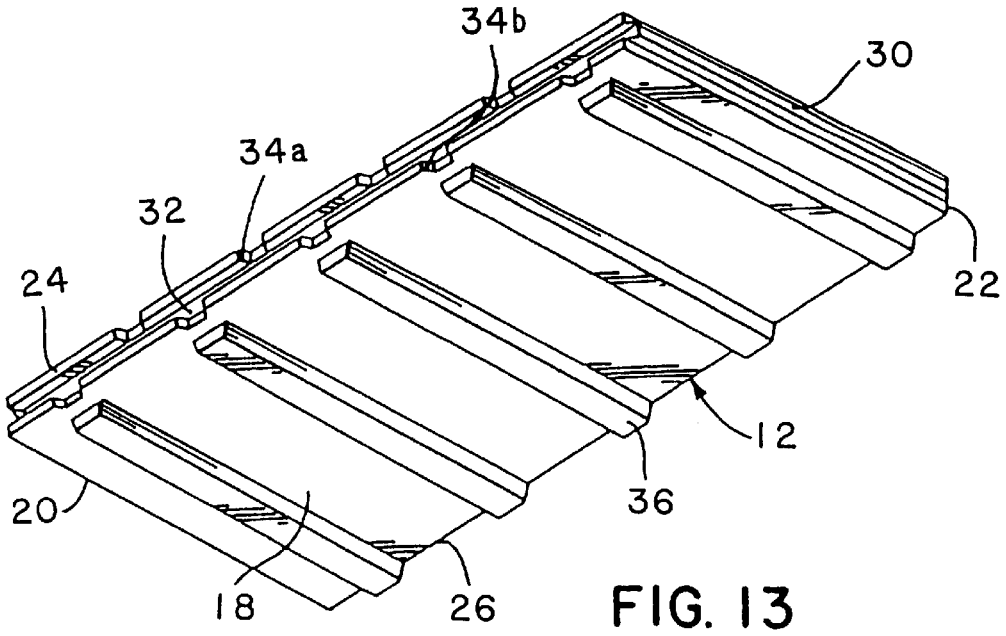
FIGS. 13 and 14 are isometric views of another preferred embodiment.
Figure 14:
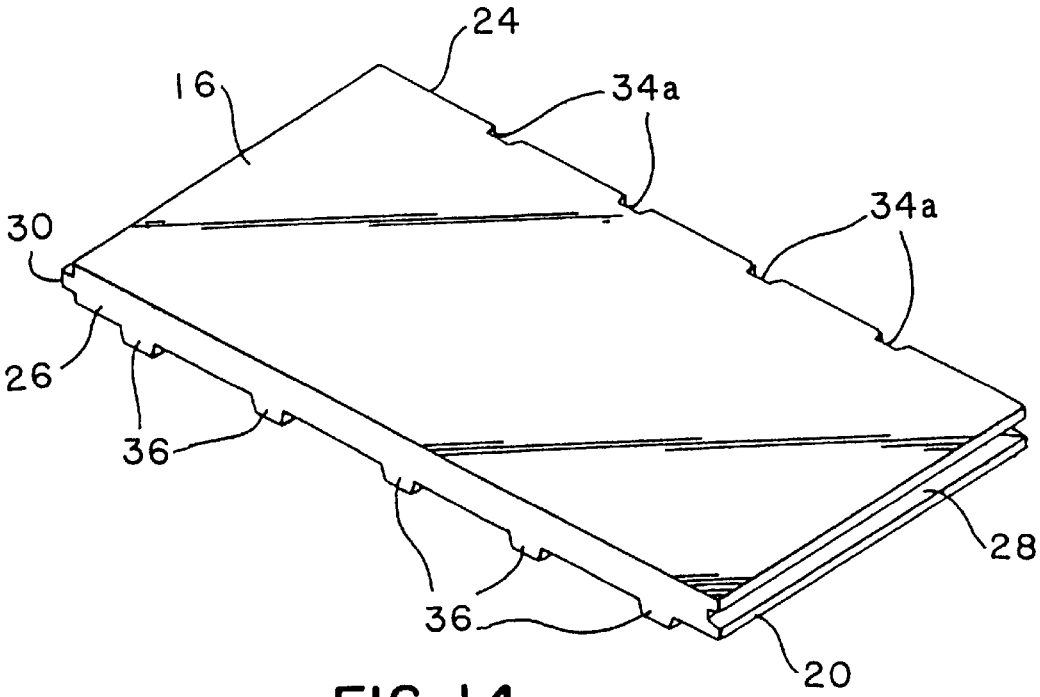
Figure 15:
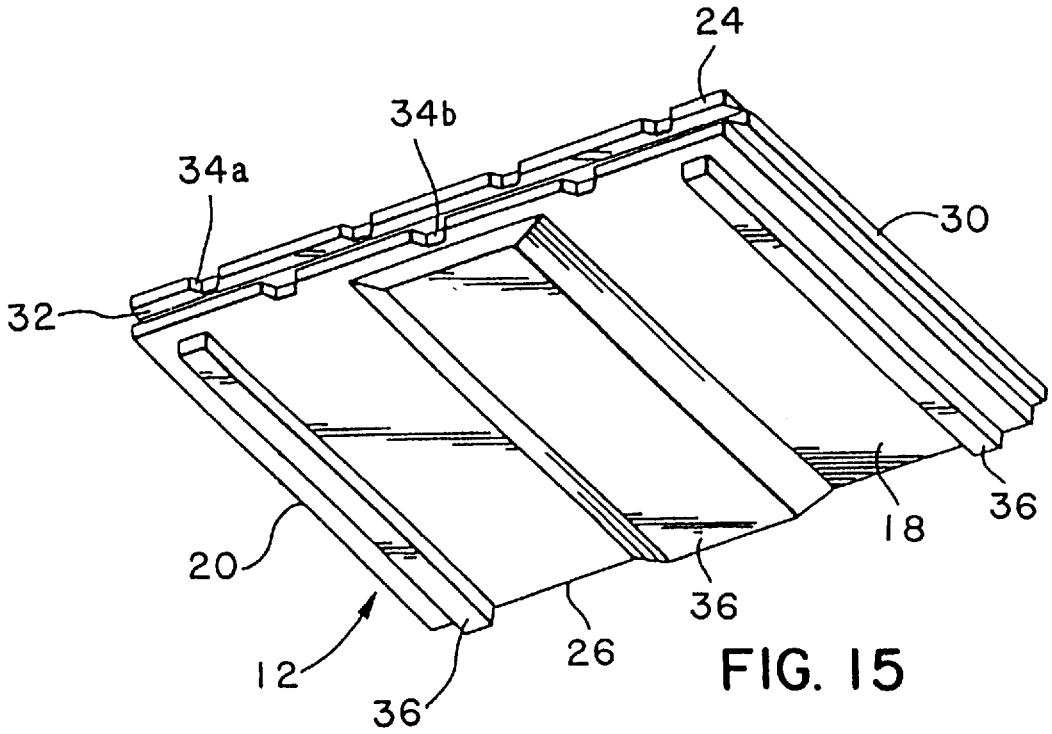
FIGS. 15 and 16 are isometric views of a still further preferred embodiment.
Figure 16:
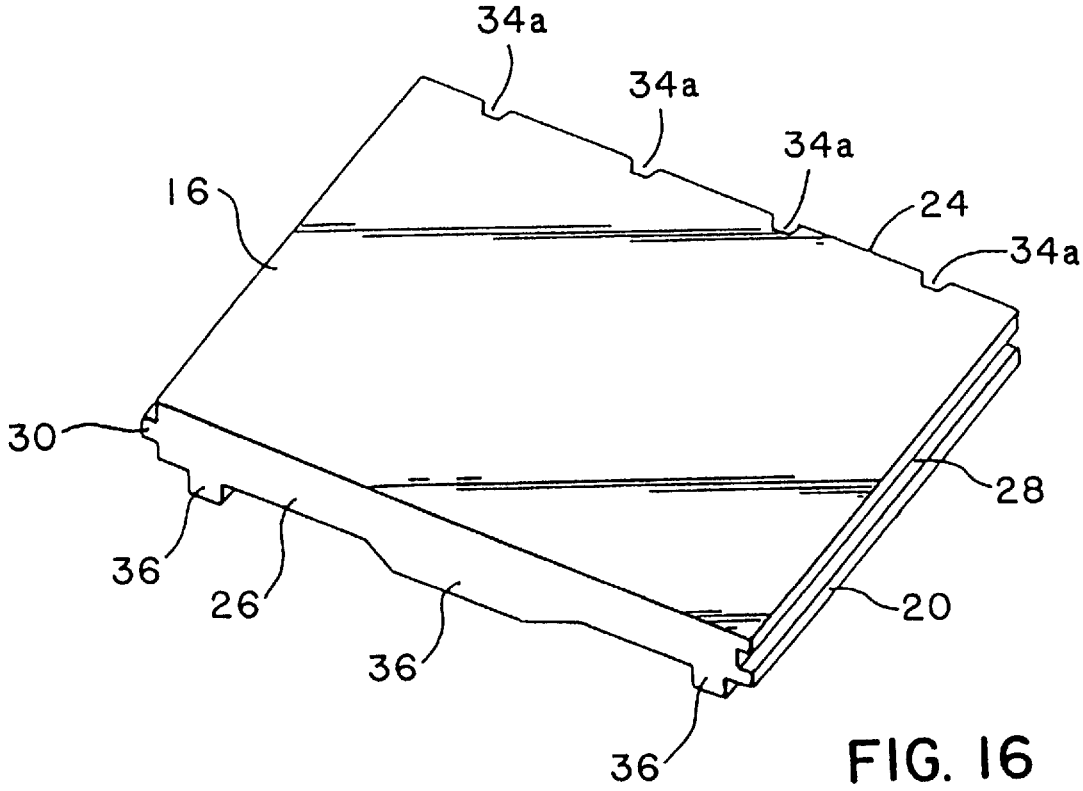

Other embodiments of a block 12 having a different means to provide air and water channels is shown in FIGS. 6, 7, 10 through 12. In these embodiments, channels 50 are provided across the thickness of the block. The channels 50 may extend perpendicular to the top and bottom sides as shown in FIG. 12, or they may be inclined relative to the top and bottom sides as shown in FIG. 10. They may extend through the body of the block, i.e. within its perimeter, or they may be located at selected edges. The channels 50 may be circular in cross-section, square, or of other cross-section. When circular, and extending directly across the body of the block, the channels 50 form circular apertures in the top and bottom sides of the block. When the channels are circular, and they extend at an angle across the block, they form elliptical apertures in the top and bottom sides of the block.

Inclined channels provide the advantage of protecting the membrane from ultra-violet radiation except at extremely low sun angles, but at such angles, the ultra-violet radiation is low anyway. The straight-across channels can provide substantially complete ultra-violet protection, if made small enough in cross-section relative to the thickness of the block. In such event, only direct overhead sunlight, occurring briefly during the day, can strike the roof membrane. The number and size of channels, and the shape of apertures, may be varied to accomplish these goals.

The blocks as depicted in the drawings and as described above, may utilize any combination of block interface means and block channel means. However, all block configurations include leg means for defining a chamber below the block.

In order to space the bottom side 18 of block 12 from the underlying support surface, parallel spaced ribs, or legs, 36 extend from edge face 26 toward edge face 24 a distance slightly less than the distance between edge faces 26 and 24. Ribs 36 thereby provide for blocks 12 a series of feet that form communicating spaces between bottom side 18 of each block 12 and roof membrane M and form a chamber C under each block for sub-block drainage. Although the ribs 36 are continuous in the illustrated embodiment, they need not be. Moreover, ribs of other configurations may be utilized provided that the desired spacing and fluid flow functions are maintained.

The course of water drainage and airflow in the channel formed across edge face 24 by the combination of recesses 34*a* and 34*b*, grooves 32, and the chamber C between the undersides of the blocks 12 and membrane M, are best illustrated by the arrows A in FIG. 3. With adjacent blocks 12 supported on membrane M, and the flat edge face 26 of one block 12 abutting grooved edge face 24 of an adjacent block 12, water will drain from the topside of the blocks 12 through to chamber C above membrane M while providing continuous ventilation in the chambers C under the blocks 12 for minimizing any aerodynamically induced pressure differential between the top and bottom sides of the blocks. Alternatively, the continuous ventilation between the topside of the block and the chamber can be accomplished with channels 50 formed directly in the body of each block as previously described. Thus, regardless of which design is utilized, when installed in the manner illustrated in FIG. 1, the blocks 12 provide an aerodynamically stable roof paving system.

The present invention enables damaged blocks to be replaced readily. To this end, blocks which become damaged after being laid in place can be easily broken out and replaced by sectional replacement blocks 12*b* and 12*c* without losing system integrity. As best seen in FIGS. 2 and 5, each of the replacement block sections 12*b* and 12*c* is dimensioned lengthwise slightly less than half the distance between edge faces 20 and 22 of full block 12. Complementary edge faces 38 and 40 in blocks 12*b* and 12*c*, respectively, interlock respectively with edge faces 22 and 20 of blocks 12 in adjacent rows. This is true whether tongue and groove, beveled, or flat edge sides are used. Beveled edge faces 42 and 44, opposite faces 38 and 40, provide mutual clearance during installation of the block sections and provide a groove across their faces when installed to receive adhesive 46 to insure positive retention. The edge faces need not be beveled to receive adhesive 46 as illustrated, but may be parallel or of some other configuration sufficient to provide installation clearance and to receive adhesive.

By way of example, and not by way of limitation, a preferred block 12 is rectangular in plan and has a lengthwise dimension of about 18 inches, a widthwise dimension of about 12 inches, and an overall thickness, excluding ribs, or legs, of about 1¼ inches. The ribs have a height of about ¼ inch. One embodiment has a center rib footprint of 7½ inches and two side rib footprints of 1 inch. The recesses forming the channels in the block edges, extend inwardly approximately ⅜ inch, and can have varying lengths of about 1 to 2 inches. The upper and lower edge recesses can be spaced apart at varying distances, for instance, about 1 to 3 inches. Preferably, the edges of the blocks are beveled as illustrated to resist breakage in handling. As described heretofore, the channels formed in the body of the block can be of various sizes and shapes. The illustrated block 12 is molded of conventional roof ballast block concrete construction. It preferably has a weight in a range of 10 to 25 pounds, and a density of 60 to 150 pounds per cubic foot.

While preferred blocks in the illustrated embodiments have the aforementioned specific dimensional and other characteristics, some variations are possible. For instance, if all of the advantages of a labyrinthine channel are not required, the edge recesses may simply extend across the edge of the block from its topside to its bottomside. The plan configuration could be varied from rectangular to square, or perhaps to other geometric configurations, provided the desired operatively engageable edge channels, and sub-block spacing legs are included to maintain the desired aerodynamic stability.

From wind tunnel tests, it has been determined that rib heights on the ballast blocks significantly affect performance of the ballast block system to resist wind lift. Therefore, in the best-mode embodiment, the ribs 36 should have heights of about ¼ inch. This height allows adequate drainage of water while providing sufficient equalization of air pressure across the top and bottom sides of the ballast block system to provide the desired aerodynamic stability. In regions of low rainfall, where less drainage beneath the blocks would be satisfactory, the height of the ribs may be reduced to a height significantly less than ¼ inch or blocks without ribs can be used.

Further variations in block structure are possible when less than severe wind conditions are anticipated. Contemplated variations which are not shown in the drawings include a block having interlocking means without leg or channel means. Likewise, blocks having just leg means or just channel means are also contemplated. Alternatively, blocks having just interlocking and leg means, or just interlocking and channel means, or just leg and channel means are possible.

Figure 18:
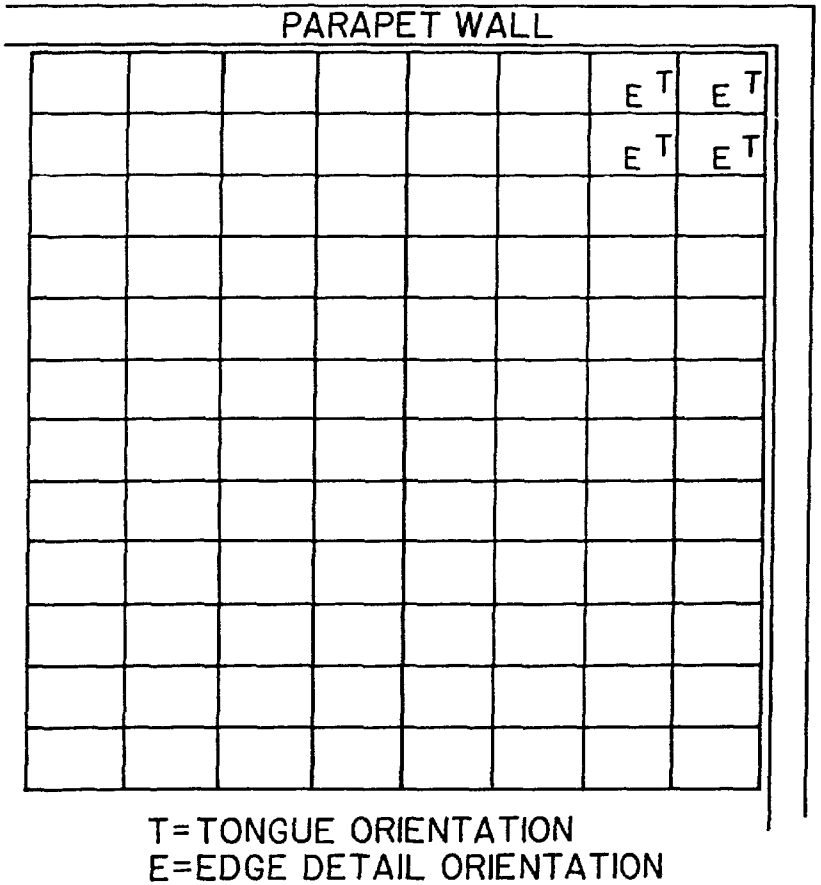
FIGS. 17–20 are plan views illustrating alternate block layout patterns.
Figure 17:
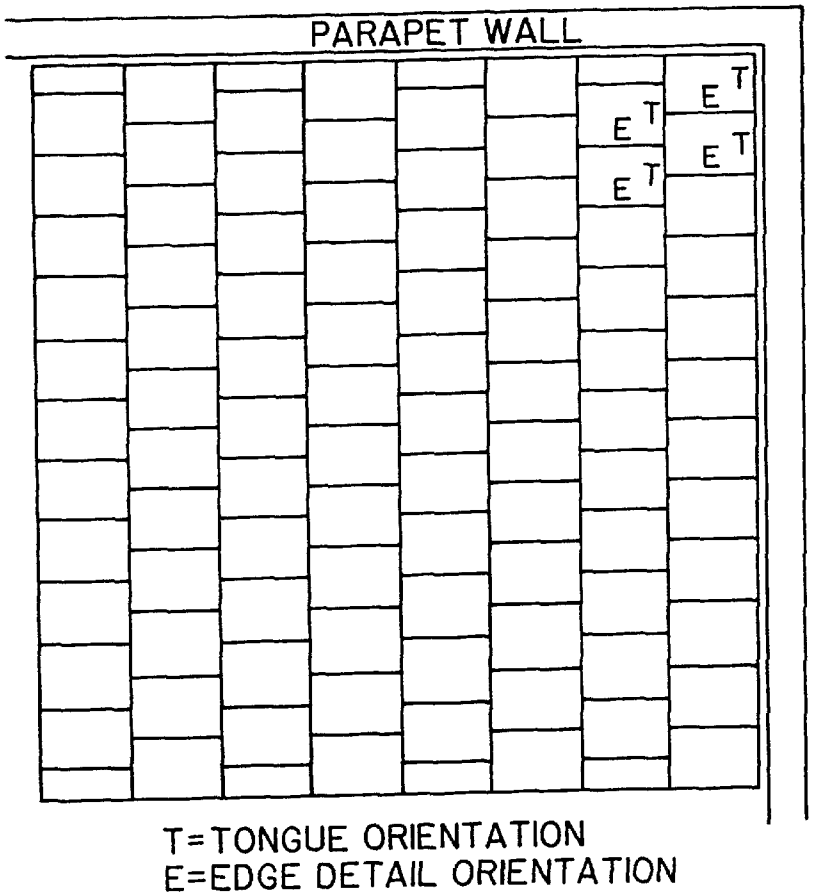
Figure 20:
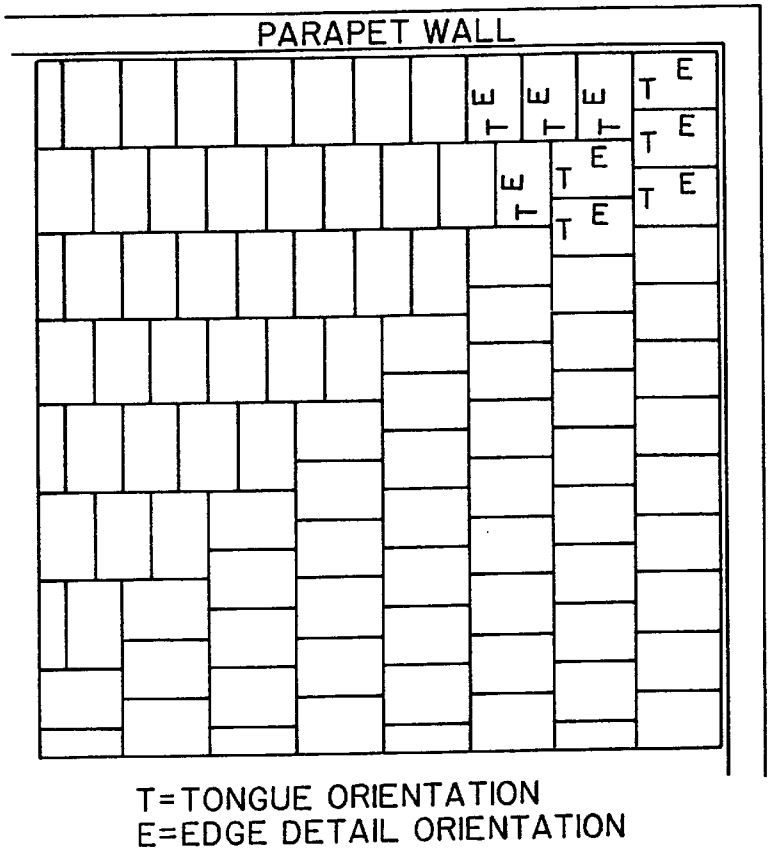
Figure 19:
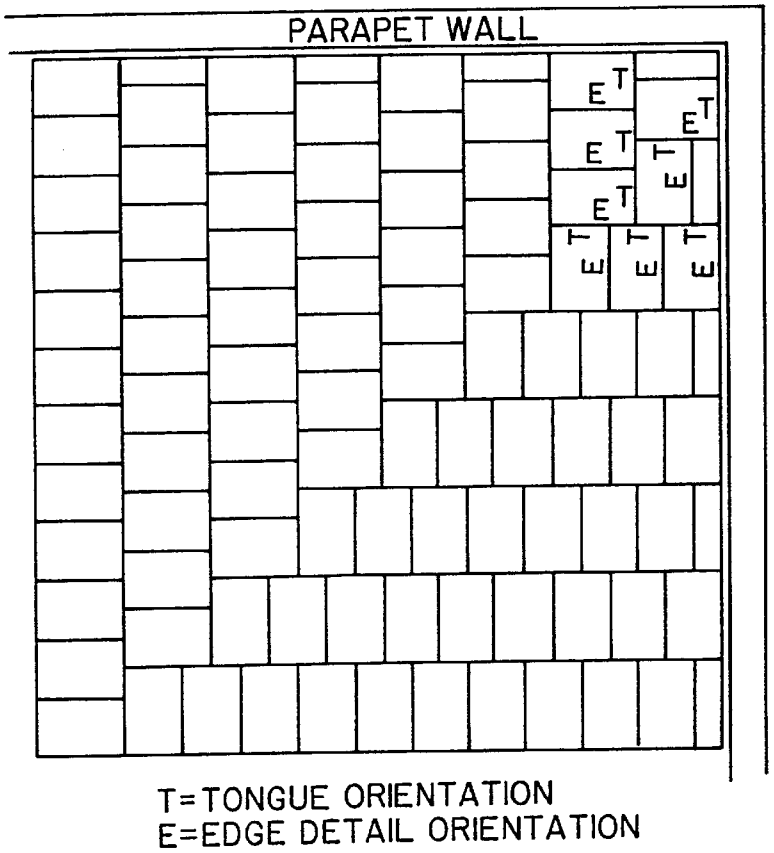

There are preferred layout patterns for the blocks. For instance, as best seen in FIG. 17, a very desirable staggered layout pattern such as illustrated in FIG. 1 is shown. FIG. 18 illustrates a so-called aligned pattern which can be utilized where anticipated wind conditions are less severe than such as would make the staggered layout pattern of FIG. 17 desirable. FIGS. 19 and 20 illustrate other staggered layout patterns which are preferred for wind conditions that are more severe than such as would make the layout pattern of FIG. 17 desirable. In these figures, the letter "E" indicates the location of the plain edge of the block, and the letter "T" indicates the location of the tongue on blocks having mating tongues and grooves. In all layout patterns some stability advantage has been found when the perimeter, or parapet, wall is provided with flashing. It is also desirable, under certain conditions, to secure the corner blocks by appropriate fasteners.

Some of the many advantages of the invention should now be readily apparent. For instance, the ballast blocks cooperate with one another to provide an aerodynamically-stable roof system particularly suited for use in unusual wind conditions. This is accomplished by arranging ballast blocks in a row and allowing air and water to flow between or through the blocks to accommodate any sudden reduction in the air pressure above the blocks that would have a tendency to lift the blocks. The ballast blocks afford a unique roof construction which substantially reduces the effect of aerodynamic lift induced by high wind conditions across the blocks. The blocks are lightweight, inexpensive to manufacture, and relatively easy to install or replace if they become damaged.

It will be understood, of course, that various changes in the details, materials, steps and arrangement of parts, which have been herein described and illustrated in order to explain the nature of the invention may be made by those skilled in the art within the spirit and scope of the invention as expressed in the appended claims.

I claim:

1. An aerodynamically stable roof ballast system for protecting a membrane type roof, said system comprising a plurality of blocks superposed on said roof in lateral relation, each of said blocks having a body with a top side, a bottom side and leg means for spacing said bottom side from said roof to define a chamber therebetween, each block also having channel means providing fluid communication between said block top side and said chamber for enabling any aerodynamically induced pressure differential across said blocks to be equalized while permitting fluid to drain through said blocks to said chamber above said roof, said channel means being provided at selected locations between laterally abutting blocks and including means forming a plurality of labyrinth side channels disposed between adjacent blocks at said selected locations, whereby the ballast system is aerodynamically stable in unusual wind conditions.

2. An aerodynamically stable roof ballast system for protecting a membrane type roof, said system comprising a plurality of blocks superposed on said roof in lateral relation, each of said blocks having a body with a top side, a bottom side and leg means for spacing said bottom side from said roof to define a chamber therebetween, each block also having channel means providing fluid communication between said block top side and said chamber for enabling any aerodynamically induced pressure differential across said blocks to be equalized while permitting fluid to drain through said blocks to said chamber above said roof, said channel means being provided at selected locations within said body of each of said blocks, extending at an angle between said top side and said bottom side, and providing in said top side an aperture that is vertically offset from an aperture it provides in said bottom side, whereby the ballast system is aerodynamically stable in unusual wind conditions.

3. An aerodynamically stable roof ballast system for protecting a membrane type roof, said system comprising a plurality of blocks superposed on said roof in lateral relation, each of said blocks having a body with a top side, a bottom side, and leg means for spacing said bottom side from said roof to define a chamber therebetween, each block having selected edge faces with complementary means for operatively engaging adjacent blocks, each block also having channel means providing fluid communication between said block top side and said chamber for enabling any aerodynamically induced pressure differential across said blocks to be equalized while permitting fluid to drain through said blocks to said chamber above said roof, said complementary means including parallel edge faces on opposite side edges of said block for operatively engaging like surfaces on adjacent blocks, wherein said parallel edge faces are beveled, whereby the ballast system is aerodynamically stable in unusual wind conditions.

4. An aerodynamically stable roof ballast system according to claim 3, where one of said edge faces intersects said top side at an acute angle and another parallel one of said edge faces intersects said bottom side at the same acute angle.

5. An aerodynamically stable roof ballast system for protecting a membrane type roof, said system comprising a plurality of blocks superposed on said roof in lateral relation, each of said blocks having a body with a top side, a bottom side, and leg means for spacing said bottom side from said roof to define a chamber therebetween, each block having selected edge faces with complementary means for operatively engaging adjacent blocks, each block also having channel means providing fluid communication between said block top side and said chamber for enabling any aerodynamically induced pressure differential across said blocks to be equalized while permitting fluid to drain through said blocks to said chamber above said roof, wherein said complementary edge faces are provided by mating tongues and grooves, whereby the ballast system is aerodynamically stable in unusual wind conditions.

6. An aerodynamically stable roof ballast system for protecting a membrane type roof, said system comprising a plurality of blocks superposed on said roof, each of said blocks having a body with a top side, a bottom side, and leg means for spacing said bottom side from said roof to define a chamber therebetween, each block having selected edge faces with complementary means for operatively engaging adjacent blocks, each block also having channel means located within each said block providing fluid communication between said block top side and said chamber for enabling any aerodynamically induced pressure differential to cross said blocks to be equalized while permitting fluid to drain through said blocks through said chamber above said roof, whereby the ballast system is aerodynamically stable in unusual wind conditions.

7. An aerodynamically stable roof ballast system according to claim 6, wherein said means for operatively engaging adjacent blocks includes a tongue on one block adapted to engage a complementary groove on a laterally adjacent block.

8. An aerodynamically stable roof ballast system according to claim 6, wherein said selected edge faces extend perpendicular to the plane of said top side.

9. An aerodynamically stable roof ballast system according to claim 6, wherein said selected edge faces are beveled.

10. For assembly with like blocks to form an aerodynamically stable roof ballast system, a ballast block having a body, a top side and a bottom side with leg means for supporting said bottom side above an underlying roof structure, said body having formed therein at least one channel providing fluid communication between said top side and said bottom side of said block, wherein said at least one channel defines an aperture on said top side and said bottom side, wherein said top side aperture is vertically offset from said bottom side aperture, and said channel connects said apertures, whereby when the blocks are laid upon a roof in laterally abutting relation, said at least one channel in said block body accommodates aerodynamically induced forces tending to lift the block by equalizing air pressure on opposite sides of the block.

11. For assembly with like blocks to form an aerodynamically stable roof ballast system, a ballast block having a body, a top side and a bottom side with leg means for supporting said bottom side above an underlying roof structure, said body having formed therein at least one channel providing fluid communication between said top side and said bottom side of said block, wherein said channel defines an aperture on said top side and said bottom side and extends across the thickness of said block, and wherein said top side aperture and said bottom side aperture are aligned vertically, whereby when blocks are laid upon a roof in laterally abutting relation, said at least one channel in said block body accommodates aerodynamically induced forces tending to lift the block by equalizing air pressure on opposite sides of the block.

12. For assembly with like blocks to form an aerodynamically stable roof ballast system, a ballast block having a body, a top side and a bottom side with leg means for supporting said bottom side above an underlying roof structure, said body having formed therein at least one channel providing fluid communication between said top side and said bottom side of said block, wherein said channel defines an aperture on said top side and said bottom side and extends through said block at an angle, wherein said top side aperture is offset from said bottom side aperture, whereby when blocks are laid upon a roof in laterally abutting relation, said at least one channel in said block body accommodates aerodynamically induced forces tending to lift the block by equalizing air pressure on opposite sides of the block.

13. For assembly with like blocks to form an aerodynamically stable roof ballast system, a ballast block having a body with a top side, a bottom side and leg means for supporting said bottom side above an underlying roof structure, said body having formed therein at least one channel providing fluid communication between said top side and said bottom side of said block, said block having peripheral edges extending between said top side and said bottom side, at least a selected one of said peripheral edges having complementary means adapted to overlap laterally with an adjacent block of like construction, whereby when the blocks are laid upon a roof in laterally abutting relation, said at least one channel in said block body accommodates aerodynamically induced forces tending to lift the block by equalizing air pressure on opposite sides of the block.

14. A ballast block according to claim 13, wherein said at least one channel defines an aperture in said top side and said bottom side, and wherein said top side aperture is vertically offset from side bottom side aperture.

15. For assembly with like blocks to form an aerodynamically stable roof ballast system, a ballast block having a body with a top side, a bottom side, and leg means for supporting said bottom side above an underlying roof structure, said block having peripheral edges extending between said top side and said bottom side, said body having formed therein at least one channel providing fluid communication between said top side and said bottom side of said block, at least a selected one of said peripheral edges of said block having complementary matingly engageable means adapted to interlock laterally with an adjacent block of like construction, whereby when the blocks are laid upon a roof in laterally interlocked abutting relation, said at least one channel in said block body accommodates aerodynamically induced forces tending to lift the blocks by equalizing air pressure on opposite sides of the block.

16. A ballast block according to claim 15, wherein said at least one channel defines an aperture in said top side and said bottom side, and wherein said top side aperture is vertically offset from said bottom side aperture.

17. A ballast block according to claim 15, wherein said at least one channel defines a recess in a side edge of said block.

18. An aerodynamically stable roof ballast system for protecting a membrane type roof, said system comprising a plurality of blocks superposed on said roof in lateral relation, each of said blocks having a topside and bottomside, each block having selected edge faces with complementary means for interlocking with adjacent blocks, said complementary interlocking means including a tongue extending along one edge of said block and a groove extending along another edge of said block opposite said tongue, wherein each of said blocks has channel means providing fluid communication between said topside and said bottomside for enabling any aerodynamically induced pressure differential across said blocks to be equalized.

19. An aerodynamically stable roof ballast system for protecting a membrane type roof, said system comprising a plurality of blocks superposed on said roof in lateral relation, each of said blocks having a body with a topside and bottomside, each block having channel means providing fluid communication between said topside and said bottomside for enabling any aerodynamically induced pressure differential across said blocks to be equalized, said channel means being provided at selected locations between laterally abutting blocks and including means forming a plurality of labyrinth side channels disposed between adjacent blocks at said selected locations.

20. An aerodynamically stable roof ballast system for protecting a membrane type roof, said system comprising a plurality of blocks superposed on said roof in lateral relation, each of said blocks having a body with a topside and bottomside, each block having channel means providing fluid communication between said topside and said bottomside for enabling any aerodynamically induced pressure differential across said blocks to be equalized, wherein said channel means is provided in said body with at least one aperture on said topside and at least one aperture on said bottomside.

* * * * *